US006859630B2

(12) United States Patent
Matsuda et al.

(10) Patent No.: US 6,859,630 B2
(45) Date of Patent: Feb. 22, 2005

(54) IMAGE TRANSFERRING AND RECORDING MEDIUM CONVEYING DEVICE AND IMAGE FORMING APPARATUS INCLUDING THE SAME

(75) Inventors: Itaru Matsuda, Kanagawa (JP); Ryoh Tanoue, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 148 days.

(21) Appl. No.: 10/328,004

(22) Filed: Dec. 26, 2002

(65) Prior Publication Data

US 2003/0123890 A1 Jul. 3, 2003

(30) Foreign Application Priority Data

Dec. 28, 2001 (JP) ..... 2001-400782

(51) Int. Cl.[7] ..... G03G 15/16
(52) U.S. Cl. ..... 399/66; 399/45; 399/314
(58) Field of Search ..... 399/310, 314, 399/66, 45

(56) References Cited

U.S. PATENT DOCUMENTS

| | | | | |
|---|---|---|---|---|
| 4,745,282 A | | 5/1988 | Tagawa et al. | 250/326 |
| 4,916,547 A | | 4/1990 | Katsumata et al. | 358/300 |
| 4,984,024 A | | 1/1991 | Ohkaji et al. | 399/299 |
| 5,189,479 A | | 2/1993 | Matsuda et al. | 399/300 |
| 5,461,461 A | | 10/1995 | Harasawa et al. | 399/66 |
| 5,495,317 A | | 2/1996 | Matsuda et al. | 399/66 |
| 5,515,146 A | | 5/1996 | Harasawa et al. | 399/310 |
| 5,557,384 A | | 9/1996 | Takano et al. | 399/313 |
| 5,598,256 A | * | 1/1997 | Kimura et al. | 399/66 X |
| 5,631,725 A | | 5/1997 | Harasawa et al. | 399/66 |
| 5,640,660 A | | 6/1997 | Takano et al. | 399/313 |
| 5,659,843 A | | 8/1997 | Takano et al. | 399/66 |
| 5,666,622 A | | 9/1997 | Harasawa et al. | 399/313 |
| 5,812,919 A | | 9/1998 | Takano et al. | 399/312 |
| 5,822,667 A | | 10/1998 | Hayama et al. | 399/314 |
| 5,897,241 A | | 4/1999 | Takano et al. | 399/66 |
| 5,909,609 A | | 6/1999 | Yahata et al. | 399/258 |
| 5,923,936 A | | 7/1999 | Tanoue et al. | 399/297 |
| 5,950,062 A | | 9/1999 | Yahata et al. | 399/358 |
| 5,978,617 A | | 11/1999 | Takano et al. | 399/61 |
| 6,002,905 A | | 12/1999 | Matsuda | 399/303 |
| 6,173,148 B1 | | 1/2001 | Matsuda et al. | 399/310 |
| 6,347,214 B1 | | 2/2002 | Kaneko | 399/397 |
| 6,434,344 B1 | * | 8/2002 | Yoshida et al. | 399/44 |
| 6,525,753 B2 | | 2/2003 | Matsuda | 347/131 |
| 6,564,020 B2 | * | 5/2003 | Kuribayashi et al. | 399/45 |

FOREIGN PATENT DOCUMENTS

| | | | |
|---|---|---|---|
| JP | 2000-187397 | * | 7/2000 |
| JP | 2000-330400 | * | 11/2000 |
| JP | 2001-051527 | * | 2/2001 |
| JP | 2001-083812 | * | 3/2001 |
| JP | 2001-154505 | | 6/2001 |
| JP | 2002-258714 | * | 9/2002 |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An image transferring and recording medium conveying device, for an image forming apparatus, which includes a nip between a belt and an image carrier for image transfer to a recording medium. A bias applying device applies a bias for image transfer to the nip. An image transfer bias Tb is applied during a leading edge interval, in which the leading edge portion of the recording medium between the leading edge and a preselected position in the direction of medium conveyance moves away from the nip. An image transfer bias Ta is applied to the nip during a remaining interval, in which the remaining portion of the recording medium moves away from the nip. A controller switches the image transfer bias Tb within a range lower than the image transfer bias Ta and greater than an image transfer bias Tc.

18 Claims, 10 Drawing Sheets

FIG. 10

| DUPLEX | Tb (μA) / L (mm) | DEFECTIVE SEPARATION (%) | | | | | IMAGE TRANSFER | | | | |
|---|---|---|---|---|---|---|---|---|---|---|---|
| | | 20 | 40 | 60 | 80 | 120 | 20 | 40 | 60 | 80 | 120 |
| FRONT | | — | — | — | — | 54 | — | — | — | — | ○ |
| | 20 | 2 | 4 | 15 | 32 | — | △ | ○ | ○ | ○ | — |
| | 30 | 0 | 0 | 0 | 25 | — | △ | ○ | ○ | ○ | — |
| | 40 | 0 | 0 | 0 | 12 | — | × | ○ | ○ | ○ | — |
| | 50 | 0 | 0 | 0 | 3 | — | × | ○ | ○ | ○ | — |
| | 60 | 0 | 0 | 0 | 2 | — | × | △ | △ | ○ | — |
| REVERSE | | — | — | — | — | 0 | — | — | — | — | ○ |
| | 20 | 0 | 0 | 0 | 0 | — | △ | ○ | ○ | ○ | — |
| | 30 | 0 | 0 | 0 | 0 | — | × | ○ | ○ | ○ | — |
| | 40 | 0 | 0 | 0 | 0 | — | × | △ | ○ | ○ | — |
| | 50 | 0 | 0 | 0 | 0 | — | × | △ | △ | ○ | — |
| | 60 | 0 | 0 | 0 | 0 | — | × | × | △ | ○ | — |

FIG. 11

| | | DEFECTIVE SEPARATION (%) | | | | | IMAGE TRANSFER | | | | |
|---|---|---|---|---|---|---|---|---|---|---|---|
| | Tb (μA) / L (mm) | 20 | 40 | 60 | 80 | 120 | 20 | 40 | 60 | 80 | 120 |
| SHIGEN S (PLAIN SHEET) | NO | — | — | — | — | 54 | — | — | — | — | ○ |
| | 20 | 2 | 4 | 15 | 32 | — | △ | ○ | ○ | ○ | — |
| | 30 | 0 | 0 | 0 | 25 | — | △ | ○ | ○ | ○ | — |
| | 40 | 0 | 0 | 0 | 12 | — | × | ○ | ○ | ○ | — |
| | 50 | 0 | 0 | 0 | 3 | — | × | ○ | ○ | ○ | — |
| | 60 | 0 | 0 | 0 | 2 | — | × | △ | △ | ○ | — |
| FINE-QUALITY 90 kg (MEDIUM SHEET) | NO | — | — | — | — | 0 | — | — | — | — | ○ |
| | 20 | 0 | 0 | 0 | 0 | — | × | × | △ | ○ | — |
| | 30 | 0 | 0 | 0 | 0 | — | × | × | △ | ○ | — |
| | 40 | 0 | 0 | 0 | 0 | — | × | × | × | △ | — |
| | 50 | 0 | 0 | 0 | 0 | — | × | × | × | × | — |
| | 60 | 0 | 0 | 0 | 0 | — | × | × | × | × | — |
| FINE-QUALITY 180 kg (THICK SHEET) | NO | — | — | — | — | 0 | — | — | — | — | ○ |
| | 20 | 0 | 0 | 0 | 0 | — | × | × | × | △ | — |
| | 30 | 0 | 0 | 0 | 0 | — | × | × | × | × | — |
| | 40 | 0 | 0 | 0 | 0 | — | × | × | × | × | — |
| | 50 | 0 | 0 | 0 | 0 | — | × | × | × | × | — |
| | 60 | 0 | 0 | 0 | 0 | — | × | × | × | × | — |

FIG. 12

| | LEADING EDGE TRANSFER BIAS CONTROL : ON (Tb : 40 μA L : 30mm) | |
|---|---|---|
| | DEVELOPING BIAS CONTROL : OFF | DEVELOPING BIAS CONTROL : ON |
| FINE-QUALITY 45kg (THIN SHEET) | 22 % | 0 % |
| SHIGEN S (PLAIN SHEET) | 0 % | 0 % |

IMAGE TRANSFERRING AND RECORDING MEDIUM CONVEYING DEVICE AND IMAGE FORMING APPARATUS INCLUDING THE SAME

BACKGROUND OF THE INVENTION

1. Field of the Invention

The present invention relates to a copier, printer, facsimile apparatus or similar image forming apparatus. More particularly, the present invention relates to an image transferring and recording medium conveying device for use in an image forming apparatus and including a belt configured to form a nip between it and an image carrier for transferring a toner image from the image carrier to a sheet or similar recording medium, bias applying means for applying a bias for image transfer to the belt, and control means for controlling the bias applying means.

2. Description of the Background Art

It is a common practice with an image forming apparatus to form a toner image on a photoconductive drum or similar image carrier and then transfer the toner image to a sheet being conveyed by a belt via a nip between the drum and the belt. The belt has medium electric resistance. To transfer the toner image from the drum to the sheet, a transfer bias source applies a charge opposite in polarity to toner to the belt. The sheet with the toner image is conveyed to fixing means by the belt while being electrostatically retained on the belt.

The conveyance of the sheet by the belt is based on the following principle. Electrostatic adhesion acts between the belt and the sheet due to an image transfer charge when the toner image is transferred from the drum to the sheet at the nip. When this electrostatic adhesion and the tendency of the sheet to straighten (hardness hereinafter) overcome adhesion acting between the sheet and the drum also derived from the image transfer charge, the sheet is separated from the drum and electrostatically retained on the belt.

However, if charge injection from the surface of the belt having medium resistance into the sheet is excessive, then the belt and sheet repulse each other because they are of the same polarity, weakening the adhesion. Further, when the sheet is curled, particularly curled in the direction in which the sheet tends to wrap around the drum (face curl), the hardness of the sheet tends to obstruct separation. Moreover, when the sheet not closely contacting the belt due to such the face curl enters the nip, spatial discharge occurs in the gap between the sheet and the belt due to the bias before the former is brought into close contact with the latter by the pressure of the nip. The spatial charge charges the sheet to the same polarity as the transfer charge, also weakening the adhesion between the sheet and the belt. Particularly, when the adhesion between the leading edge portion of the sheet in the direction of conveyance and the belt is weakened, the leading edge of the sheet is apt to wrap around the drum without being retained on the belt, resulting in defective sheet separation. The separation of the sheet from the drum is susceptible not only to the resistance of the belt but also to the resistance, thickness and smoothness of the sheet. A thin sheet and a sheet with low resistance, among others, are disadvantageous as to separation from the drum.

Technologies relating to the present invention are disclosed in, e.g., Japanese Patent Laid-Open Publication No. 2001-154505.

SUMMARY OF THE INVENTION

It is an object of the present invention to provide an image transferring and recording medium conveying device capable of insuring stable separation of a recording medium from an image carrier and allowing the medium to be surely electrostatically retained on a belt, and an image forming apparatus including the same.

A recording medium conveying device of the present invention includes a belt configured to form a nip for image transfer between it and an image carrier for conveying a recording medium via the nip to thereby transfer a toner image formed on the image carrier to the recording medium. A bias applying device applies a bias for image transfer to the nip while a controller controls the bias applying device. Assume that a leading edge transfer bias Tb is applied during a leading edge interval in which the leading edge portion of the recording medium between the leading edge and a preselected position in a direction of medium conveyance moves away from the nip, and that a remaining interval transfer bias Ta is applied to the nip during a remaining interval in which the remaining portion of the recording medium moves away from the nip. Then, the controller switches the leading edge transfer bias Tb within a range lower than the remaining interval transfer bias Ta.

BRIEF DESCRIPTION OF THE DRAWINGS

The above and other objects, features and advantages of the present invention will become more apparent from the following detailed description taken with the accompanying drawings in which:

FIG. 10 is a table listing experimental results relating to the separation of a sheet and image transfer and determined with the embodiment of FIG. 1;

FIG. 11 is a table listing experimental results relating to the separation of a sheet and image transfer and determined with another alternative embodiment of the present invention; and FIG. 12 is a table listing experimental results relating to the separation of a sheet and determined with the embodiment of FIG. 7.

DESCRIPTION OF THE PREFERRED EMBODIMENTS

Figure 1:
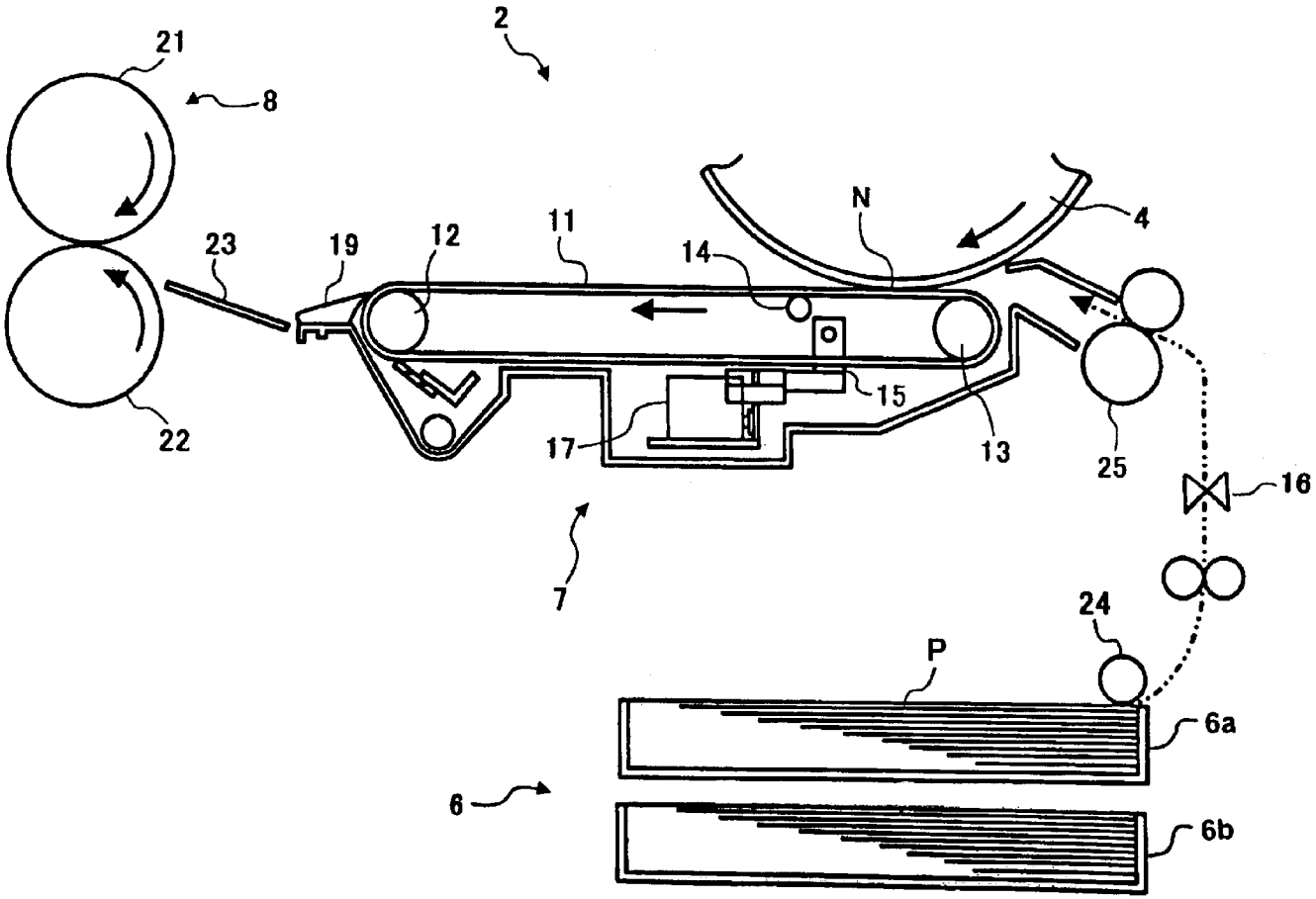
FIG. 1 is a view showing an image forming apparatus embodying the present invention.

Referring to FIG. 1 of the drawings, an image forming apparatus embodying the present invention is shown and implemented as a digital copier by way of example. As shown, the digital copier, generally 2, includes image scanning means 3 (see FIG. 2) and a photoconductive drum or image carrier 4 that forms part of an image forming section not shown. A sheet cassette 6*a* is loaded with a stack of sheets P and forms part of a sheet feeding section not shown. It is to be noted that a sheet P is representative of a recording medium to be dealt with in the illustrative embodiment. A belt unit or image transferring and recording medium conveying device 7 conveys one sheet P fed from the sheet cassette 6 and to which a toner image is transferred from the drum 4. A fixing unit or fixing means 8 fixes the toner image on the sheet P. The copier 2 additionally includes an operation panel or inputting means 9 (see FIG. 2) and a controller or control means 10 (see FIG. 2) for controlling the entire copier 2 as well as transfer bias applying means, which will be described specifically later. The controller 10 is representative of a microcomputer including a CPU (Central Processing Unit), a ROM (Read Only Memory), and an I/O (Input/Output) interface.

The belt unit 7 includes a belt 11, a drive roller 12, a driven roller 13, a bias roller 14, and a high-tension power supply 17. The belt 11 is implemented as an elastic, medium-resistance member formed of, e.g., rubber. The belt 11 is passed over the drive roller 12 and driven roller 13. The drive roller 12 is made up of a metallic core and a rubber layer wrapped around the core. The driven roller 13 is formed of metal and plays the role of a feedback roller at the same time.

A drive source, not shown, is drivably connected to the drive roller 12 and causes it to move the belt 11 in a direction indicated by an arrow in FIG. 1. The surface of the drive roller 12 and the inner surface of the belt 11 both are formed of rubber having a high coefficient of friction, so that the rotation of the drive roller 12 is surely transferred to the belt 11 without any slip. The driven roller 13 is caused to rotate by the belt 11.

The fixing unit 8 includes a heat roller 21 accommodating a halogen heater therein and a press roller 22 pressed against the heat roller 21 to thereby form a nip. The heat roller 21 and press roller 22 constitute fixing means in combination. An inlet guide 23 guides the sheet P to the above nip.

The belt 11 contacts the drum 4 over a nip N for image transfer. The drum 4 is uniformly charged to negative polarity by charging means, not shown, and then exposed imagewise by exposing means, not shown, so that a latent image is formed on the drum 4. A developing section, not shown, deposits toner on the latent image to thereby form a corresponding toner image.

The top sheet P on the sheet cassette 6 is paid out by a pickup roller 24 while being separated from the underlying sheets P and is conveyed to a registration roller pair 25. The registration roller pair 25 once stops the sheet P and then conveys it toward the nip N for image transfer such that the leading edge of the sheet P meets the leading edge of the toner image carried on the drum 4.

The bias roller 14, applied with a bias of positive polarity, transfers the toner image of negative polarity from the drum 4 to the sheet P at the nip N. The sheet P with the toner image is electrostatically retained on the belt 11 and conveyed thereby.

The surface of the belt 11 is formed of a fluorine-based material and has a coefficient of friction small enough to implement stable cleaning. More specifically, polyvinylidene fluoride or 4-ethylene fluoride, for example, is coated on the surface of the belt 11 together with a dispersant to thickness of 5 $\mu$m to 15 $\mu$m, providing the surface with resistivity of $1\times10^{10}$ Ω to $1\times10^{12}$ Ω in terms of JIS (Japanese Industrial Standards) K6911 scale. Abase layer, underlying such a surface layer, is formed of chloroprene rubber, EPDM rubber or similar rubber or a mixture thereof. Carbon, a metal oxide or similar conductive material may be added to the rubber for controlling resistance. The surface of the base layer should preferably have resistivity of $1\times10^{7}$ Ω to $5\times10^{9}$ Ω in terms of JIS K6911 scale.

The bias roller 14 is formed of SUS (stainless steel) or similar metal and held in contact with the inner surface of the belt 11 at a position downstream of the nip N in the direction of movement of the belt 11. The bias roller 14 is connected to the high-tension power supply 17 via a bias terminal 15.

The high-tension power supply 17 includes a current control section. The current control section compares a current I1 fed to the belt 11 via the bias roller 14 and a current I2 fed back from the belt 11 via the driven roller 13 without flowing to the drum 4, and controls the output of the power supply 17 such that the difference (I1–I2) has a constant value K. This maintains an image transfer current Ta to flow from the belt 11 to the drum 4 constant (substantially K) and thereby allows the toner image to be transferred to the sheet P in a stable condition.

An outlet guide 19 is so positioned as to guide the sheet P peeled off from the belt 11 to the fixing unit 8. The outlet guide 19 is formed of resin with medium resistance, e.g., anti-static ABS or a mixture of polycarbonate and ABS. The outlet guide 19 is provided with volume resistivity of $1\times10^{8}$ Ωcm to $1\times10^{13}$ Ωcm close to the resistance of the belt 11.

The drum 4 rotates at a linear velocity of 500 mm/sec. The bias roller 14 is 300 mm long in the axial direction. The image transfer current Ta is usually selected to be 120 $\mu$A for a sheet P of size A3.

Characteristic features of the illustrative embodiment will be described hereinafter. Assume that the image transfer current Ta for transferring the toner image from the drum 4 to the sheet P is constant. Then, it is likely that the leading edge portion of the sheet P adheres to the drum 4 at the outlet of the nip N and cannot be peeled off, depending on the kind of the sheet P. In light of this, the illustrative embodiment executes the following unique control over the image transfer current. Briefly, a leading edge transfer current or bias Tb is applied during a leading edge interval in which the leading edge portion of the sheet P between the leading edge and a preselected position moves away from the nip N. The leading edge transfer current Tb is switched in accordance with the kind of the sheet P within a range below a remaining interval transfer current Ta (equal to the transfer current Ta), which is applied during the remaining interval in which the other portion of the sheet P moves away from the nip N. Such control will be referred to as leading edge transfer current control hereinafter.

Figure 3:
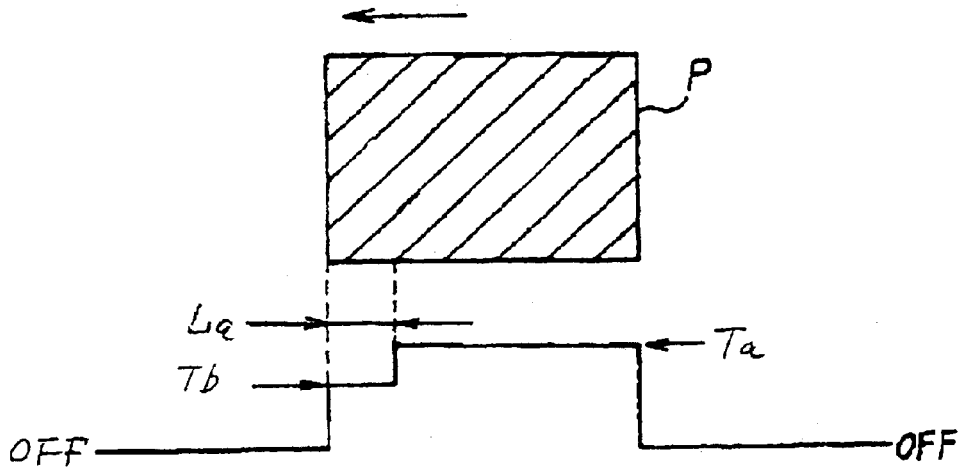
FIG. 3 demonstrates a specific transfer bias application timing unique to the illustrative embodiment.

More specifically, FIG. 3 shows a relation between the position of the sheet P and the timing of the transfer current. As shown, the transfer current is turned off (OFF) when the sheet P is absent, e.g., during an interval between consecutive sheets P. The leading edge transfer current Tb starts being applied in synchronism with the leading edge of the sheet P over a preselected length Lo (mm) from the leading edge of the sheet P (switching length Lo hereinafter). After the switching length Lo of the sheet P has moved away from the nip N, the leading edge transfer current Tb is replaced with the remaining interval transfer current Ta up to at least the trailing edge of the sheet P.

We conducted a series of experiments for determining how the size of the leading edge transfer-current Tb and the switching length L of the sheet P effect sheet separation and image transfer. The experiments were conducted with sheets SHIGEN (trade name) available from NBS Ricoh in a duplex copy mode. FIG. 10 lists the results of experiments.

As FIG. 10 indicates, as for the front side of the sheet (equivalent to a simplex copy mode), the leading edge transfer current Tb and switching length each have an optimum range that implements both of desirable sheet separation and desirable image transfer. More specifically, when use is made of SHIGEN S or similar fine-quality sheet (corresponding to 55 kg to 60 kg), for the front side in the duplex mode, the leading edge transfer current Tb should preferably be 40 $\mu$A to 60 $\mu$A for the remaining interval transfer current Ta of 120 $\mu$A while the switching length L should preferably be about 30 mm to 50 mm. As for the reverse side of the sheet P in the duplex mode, the sheet P is satisfactorily separated without resorting to the leading edge transfer current Tb; switching the current Tb might bring about defective image transfer.

Figure 2:
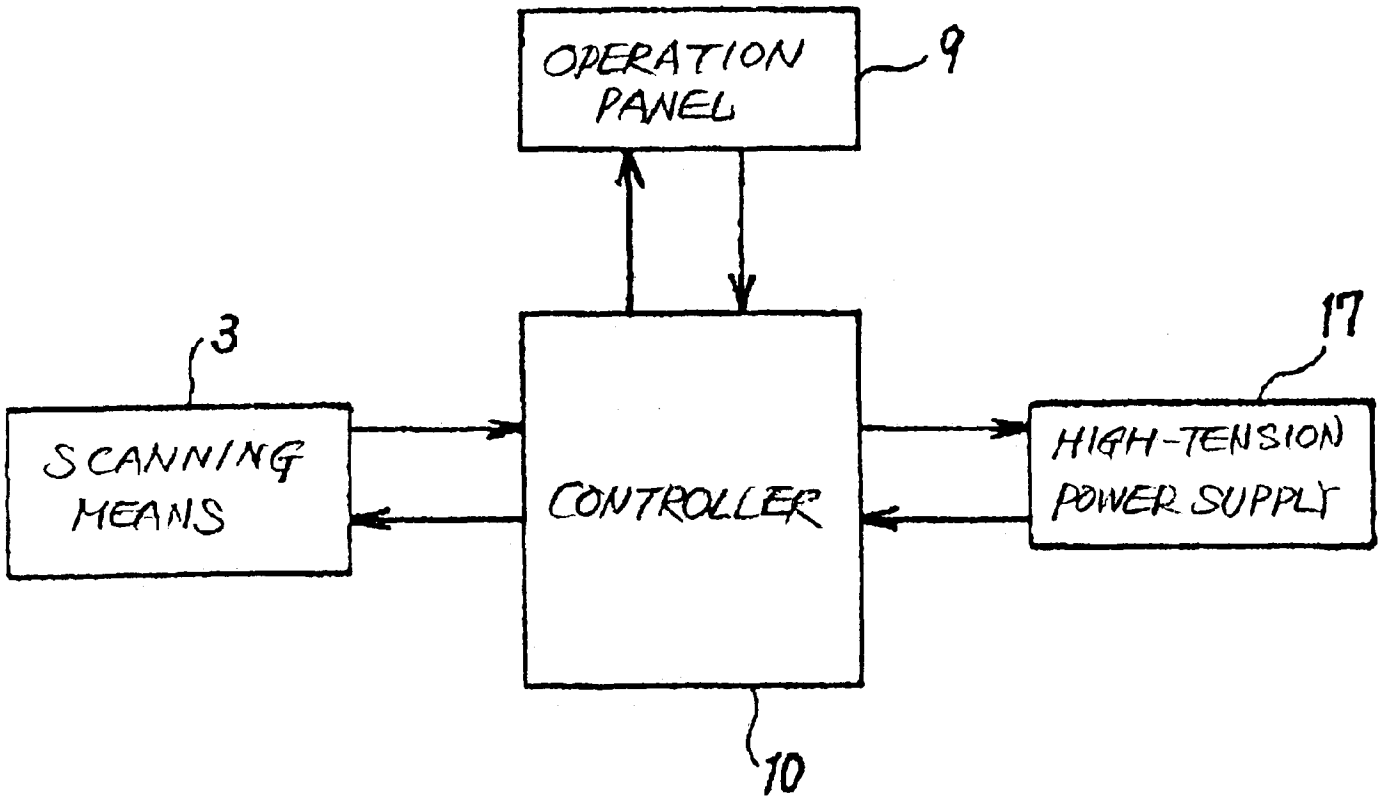
FIG. 2 is a schematic block diagram showing a control system included in the illustrative embodiment.

The controller 10, FIG. 2, determines which of the simplex mode and duplex mode is to be executed and, in the case of the duplex mode, which of the front side and reverse side of the sheet P is to be dealt with in accordance with information input on the operation panel 9, FIG. 2. In the case of the simplex mode or the front side in the duplex mode, the controller 10 executes the leading edge transfer current control with the leading edge transfer current Tb of 40 $\mu$A and switching length L of 40 mm. In the case of the reverse side in the duplex mode, the control means 10 does not effect the above control, i.e., causes the remaining interval transfer current Ta (=120 $\mu$A) to be applied from the leading edge to the trailing edge of the sheet P. With this kind of control, the illustrative embodiment promotes reliable separation of the sheet P while insuring desirable image transfer.

Figure 4:
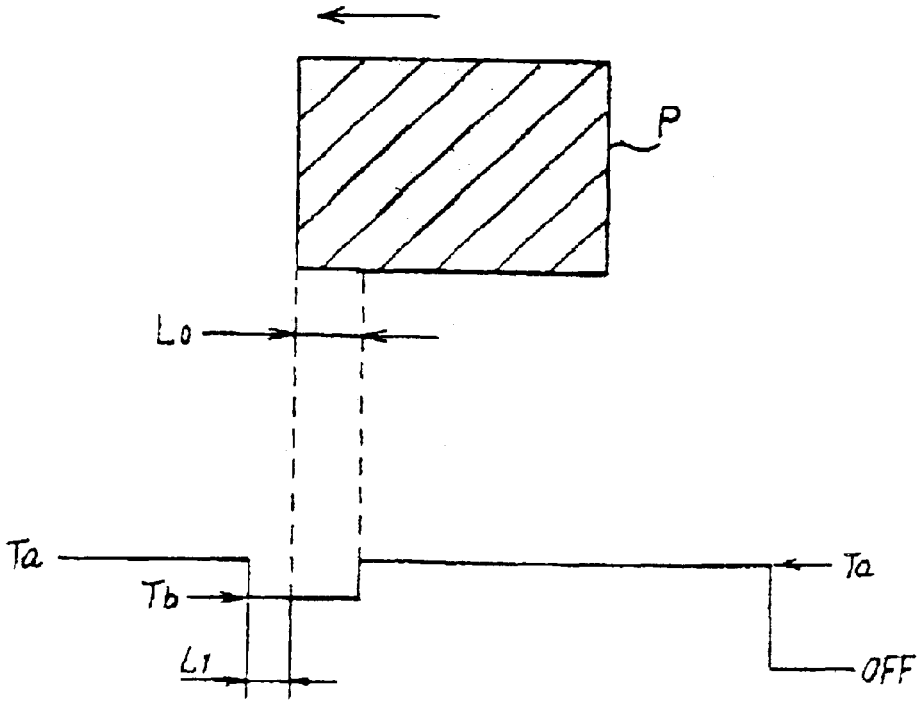
FIGS. 4 through 6 each demonstrate another specific transfer bias application timing available with the illustrative embodiment.

In the illustrative embodiment, the image transfer current is applied only when the sheet P is conveyed via the nip N. The illustrative embodiment is similarly applicable to a copier of the type applying the image transfer current even during, e.g., an interval between consecutive sheets. FIG. 4 shows a first modification of the illustrative embodiment that applies the remaining interval transfer current Ta even to, e.g., an interval between the consecutive sheets. Assume that the leading edge transfer current control shown in FIG. 4 is applied to the simplex mode and the front side in the duplex mode hereinafter.

The remaining interval transfer current Ta applied during an interval between sheets P might obstruct the stable separation of the sheet P. In light of this, as shown in FIG. 4, the modification replaces the remaining interval transfer current Ta with the leading edge transfer current Tb, which is smaller than the current Ta, at a point preceding the leading edge of the sheet P by a distance L1, and then outputs a leading edge output current Tb over the switching length Lo. More specifically, the remaining interval transfer current Ta of, e.g., 120 $\mu$A is replaced with the leading edge transfer current Tb of 40 $\mu$A at a point preceding the leading edge of the sheet P by the distance L1 of 20 mm; the switching length L maybe 40 mm. As for the reverse side in the duplex mode, the leading edge transfer current control is not executed as in the illustrative embodiment, i.e., the remaining interval transfer current Ta of 120 $\mu$A is continuously output. The modification is also successful to promote reliable separation of the sheet P while insuring desirable image transfer.

Figure 5:
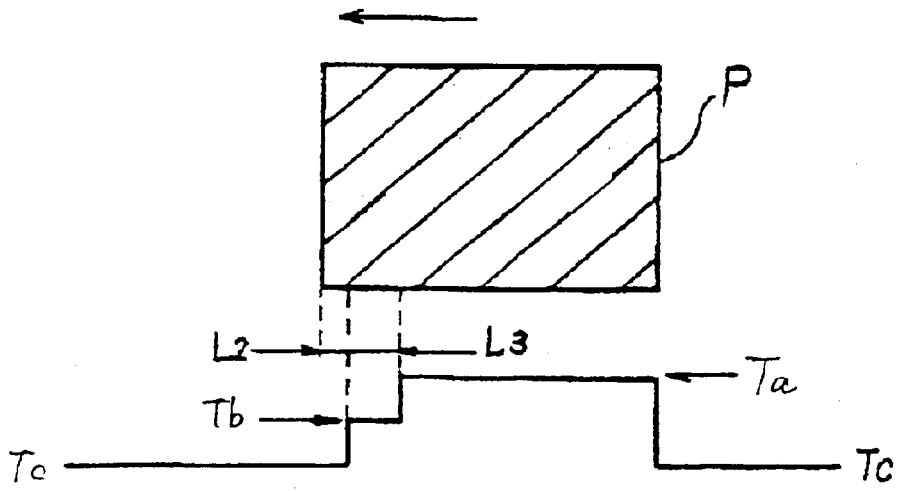

Another modification of the illustrative embodiment applies an image transfer current smaller than the image transfer current assigned to image transfer during, e.g., an interval between consecutive sheets, as will be described hereinafter with reference to FIG. 5.

Assume the remaining interval transfer current Ta assigned to image transfer and an image transfer current Tc assigned to a range in which the sheet P is absent, e.g., between sheets (between-sheet transfer current hereinafter). FIG. 5 shows a relation between the position of the sheet P and the image transfer current output timing on the assumption that the copier satisfies a relation of Tc<Ta. As shown, because the between-sheet transfer current Tc is effective as to sheet separation even when applied to the leading edge portion of the sheet P, it is output over a distance L2 of, e.g., 10 mm from the leading edge of the sheet P. Subsequently, the leading edge transfer current Tb is output over a switching length L3 of, e.g., 30 mm slightly later than the current Tc, i.e., from a point remote from the leading edge of the sheet P by the distance L2. It is to be noted that the timing for switching the leading edge transfer current Tb may be synchronous to or slightly earlier than the leading edge of the sheet P.

Figure 6:
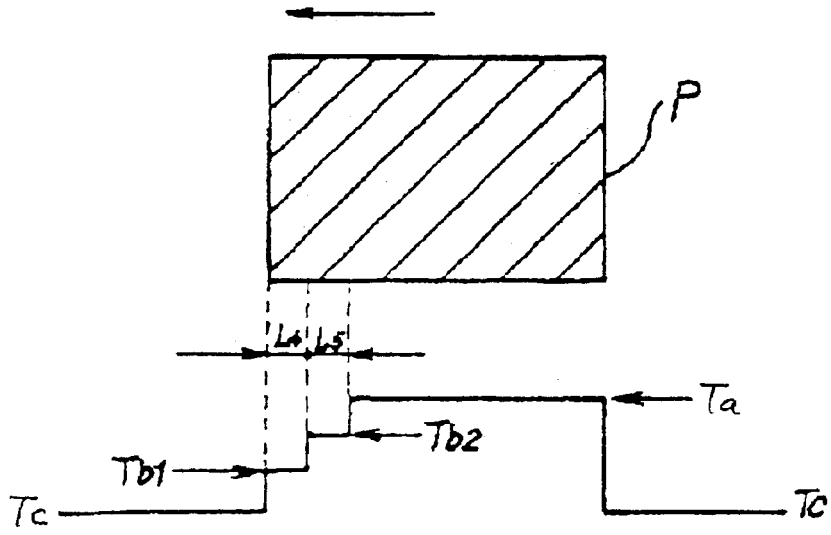

FIG. 6 shows still another modification of the illustrative embodiment in which the leading edge transfer current Tb is controlled in two steps. As shown, a first leading edge transfer current Tb1 of, e.g., 40 $\mu$A is output over a distance L4 of, e.g., 15 mm from the leading edge of the sheet P. Subsequently, a second leading edge transfer current Tb2 of, e.g., 80 $\mu$A higher than the current Tb1 but lower than the current Ta, is output over a distance L5 of, e.g., 15 mm. This modification broadens the satisfactory range as to both of sheet separation and image transfer.

While the above modification switches the leading edge transfer current Tb stepwise, the startup or rising characteristic of the power supply 17 may be made slower than usual so as to increase the current Tb in a continuous or stepless fashion.

Sheet separation and image transfer available with the leading edge transfer current control effected with various kinds of sheets in the simplex mode will be described hereinafter as an alternative embodiment of the present invention. FIG. 11 shows experimental results relating to sheet separation and image transfer determined with plain sheets, medium sheets with medium thickness, and thick sheets.

As FIG. 11 indicates, an increase in sheet thickness is advantageous for sheet separation, but disadvantageous for image transfer. Therefore, when the sheet P is a plan sheet, the illustrative embodiment executes, in FIG. 3 by way of example, the leading edge transfer current control with the leading edge transfer current Tb of 40 $\mu$A and switching length L of 40 mm. When the sheet P is a medium sheet or a thick sheet, the illustrative embodiment applies 120 $\mu$A equal to the remaining interval transfer current Ta as the leading edge transfer current Tb.

Further, an arrangement may be made such that a particular leading edge transfer current Tb and a particular switching length Lo can be set for each of a plurality of sheet cassettes 6*a*, 6*b* included in the copier, in which case the adjustable values will be varied in accordance with the kind of sheets set on the tray. A particular leading edge transfer current Tb and a particular switching length Lo may additionally be set for each of the simplex mode, the front side and reverse side in the duplex mode, and the kind of sheets to be used.

Another alternative embodiment of the present invention will be described hereinafter. Briefly, the embodiment to be described deposits a small amount of toner on the leading edge portion of the sheet P in order to obviate defective separation when the sheet P is thinner than a plain sheet, while executing the leading edge transfer current control.

Figure 7:
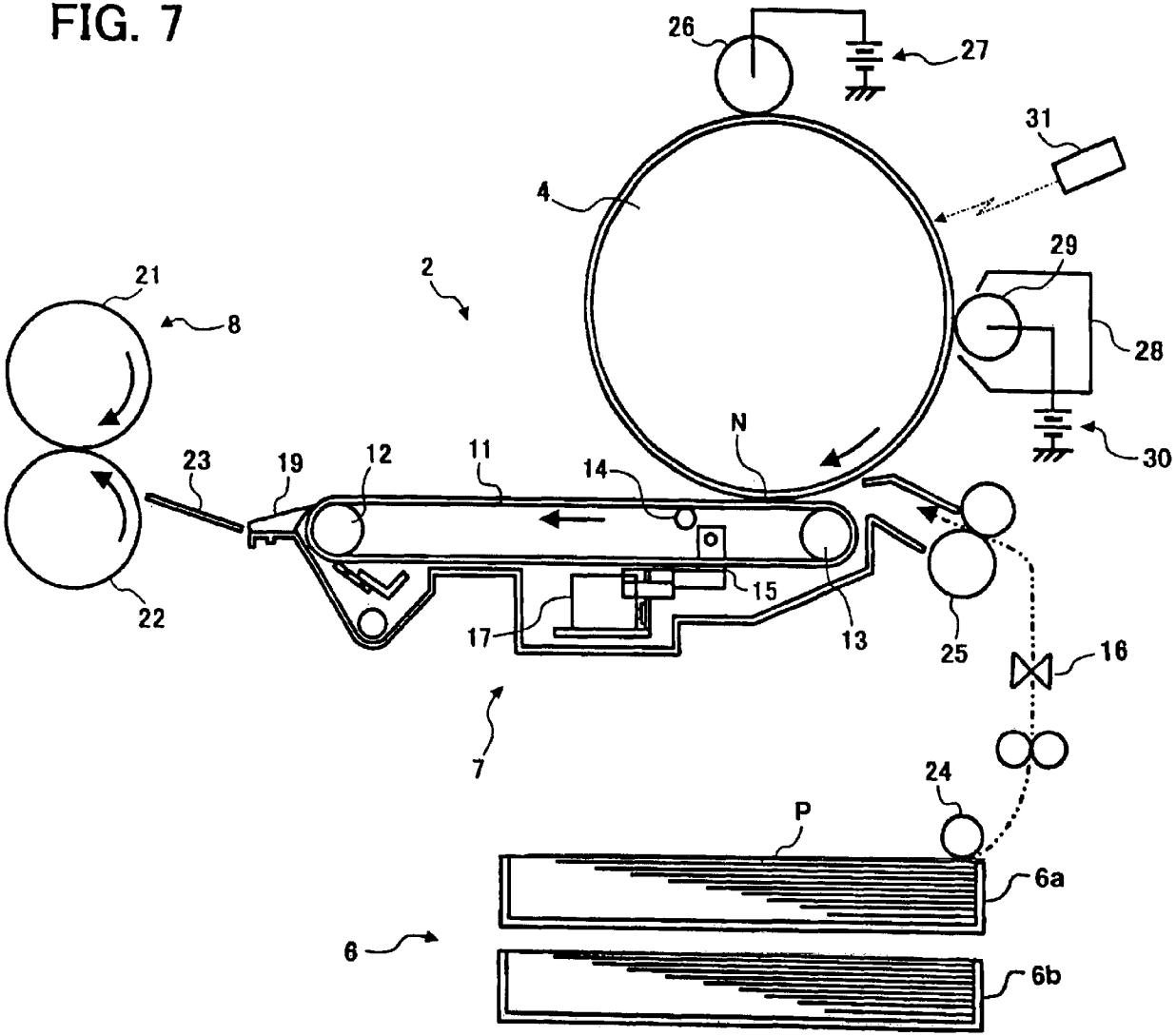
FIG. 7 is a view showing an alternative embodiment of the image forming apparatus in accordance with the present invention.
Figure 8:
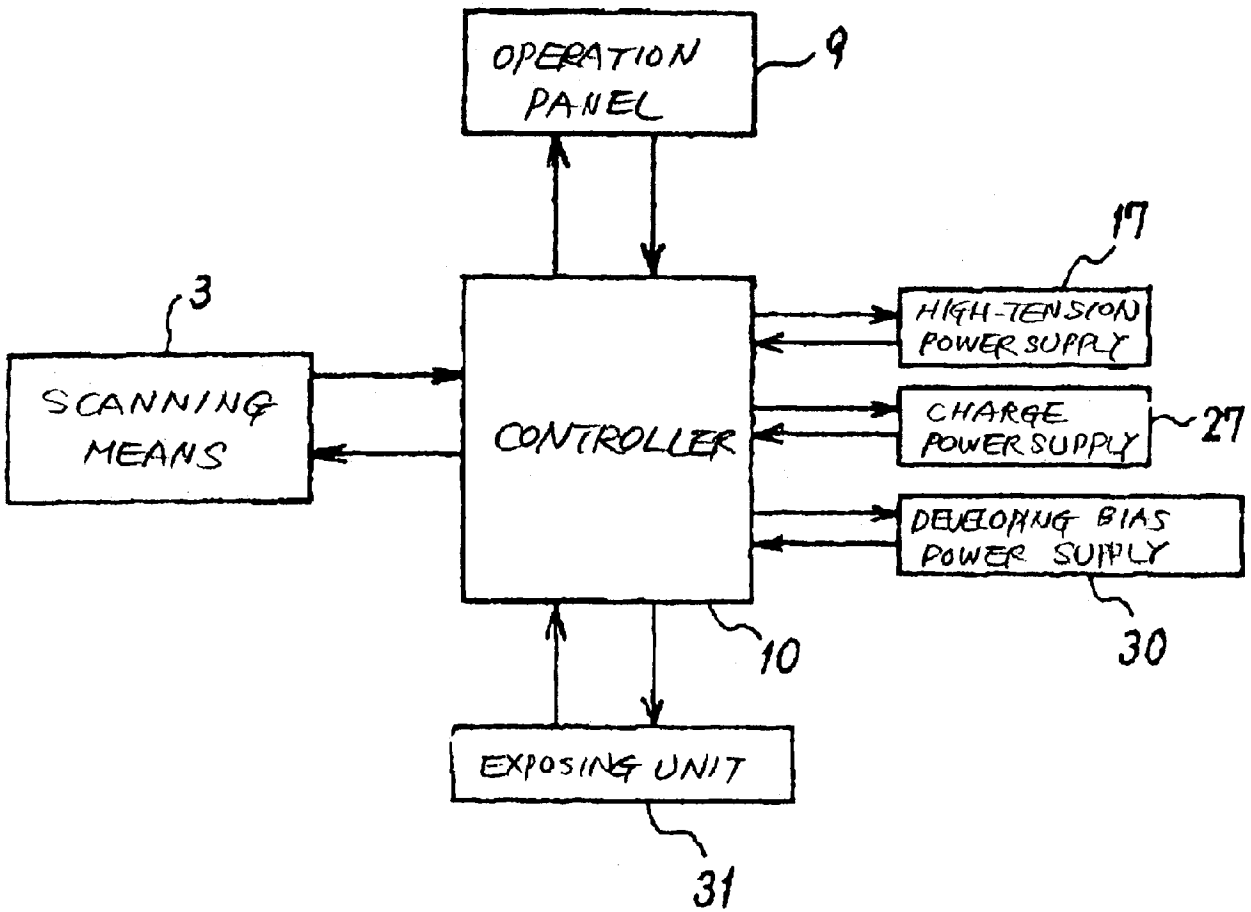
FIG. 8 is a schematic block diagram showing a control system included in the alternative embodiment.

More specifically, as shown in FIG. 7, a power supply 27 is connected to a charge roller or charging means 26 and controlled such that the charge roller 26 uniformly charges the surface of the drum 4 to a potential VD of −900 V. Also, a bias power supply 30 is connected to a developing roller 29 included in a developing unit 28 and is so controlled as to output a bias VB of −600 V during usual image formation. As shown in FIG. 8, the power supplies 27 and 30 are connected to the controller 10 to be controlled thereby.

Figure 9:
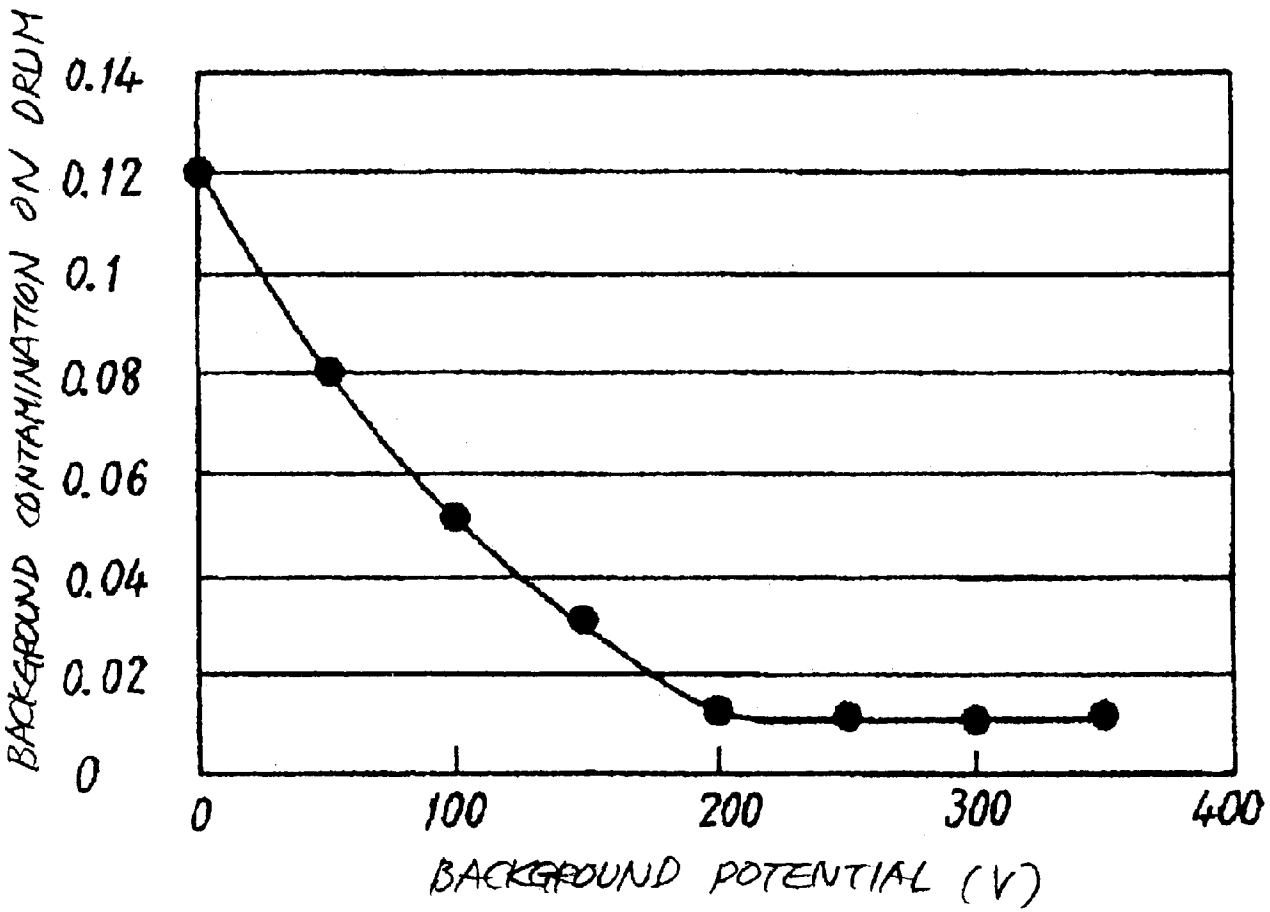
FIG. 9 is a graph showing a relation between a background potential and the background contamination of a photoconductive element.

The illustrative embodiment executes reversal development in which toner of negative polarity is deposited on the portion of the drum 4 where the potential is lowered by an exposing unit or exposing means 31. In this sense, a background potential for preventing the toner from depositing on the non-image portion of the drum 4 is represented by |VD−VB|. FIG. 9 shows a relation between the background potential and the background contamination of the drum 4. Background contamination is represented by the density of toner determined by collecting the background contamination with a transparent adhesive tape, adhering the tape to a plain white sheet, measuring the contamination with a reflection type densitometer, and then canceling the density of the white sheet. While the background potential during usual image formation is 300 V and brings about background contamination little, the background potential of 150 V or below aggravates contamination little by little.

In the illustrative embodiment, the timing for charging and then developing the portion of the drum 4 corresponding to the range where the leading edge transfer bias control (Tb) is executed is controlled to thereby control at least one of the charge potential VD and bias VB for development. For example, the controller 10 maintains the bias VB at −600 V and so controls the power supply 27 as to establish a charge potential of −750 V. Alternatively, the controller 10 may fix the charge potential VD at −900 V and so control the bias power supply 30 as to establish a bias VB of −750 V. In any case, the background potential is controlled to 150 V. Consequently, the amount of toner contaminating the background increases in the portion of the drum 4 corresponding to the range where the leading edge transfer bias control (Tb) is executed. Such toner weakens the electrostatic adhesion of the sheet P to the drum 4 for thereby further stabilizing the separation of the former from the latter, compared to the case where it is absent or almost absent.

FIG. 12 shows experimental results comparing the case wherein the background potential control is executed while the bias VB of −750 V is selected and the case wherein the background potential control is not executed while bias VB of −600 V is selected as to the separation of a fine-quality 45 kg sheet (thin sheet) and a plain sheet SHIGEN S. In both of the two cases, the charge potential VD is fixed at −900 V. Although the amount of toner contaminating the background increases in the portion of the drum 4 corresponding to the range where the leading edge transfer bias control (Tb) is executed, the amount of such toner to be transferred to the sheet P decreases because of the bias Tb lower than the usual bias Ta and is therefore inconspicuous.

Further, the exposure of the drum 4 by the exposing unit 31 may be controlled such that a small amount of toner deposits on the portion of the drum 4 corresponding to the range where the leading edge transfer bias control (Tb) is executed. More specifically, exposure control usually executes pulse width modulation (PWM) with a duty of 100%. The PWM duty may be reduced to 20% or below in order to reduce the turn-on time and therefore the substantial amount of light for a single dot. When the portion of the drum 4 corresponding to the range where the leading edge transfer bias control (Tb) is executed is exposed in the above condition, the charge potential VD of −900 V is lowered to about −700 V and causes a small amount of toner to deposit on the above portion. This is also successful to weaken the adhesion of the sheet P tot he drum 4 for thereby further stabilizing the separation of the sheet P.

If desired, the exposure control stated above may write a dot or a line pattern on the particular portion of the drum 4 instead of constant writing. The PWM control may, of course be replaced with power modulation (PM) control. The background potential control may be combined with the exposure control, if desired. Further, the portion of the drum 4 where a small amount of toner is expected to deposit does not have to be fully synchronous with the range where the leading edge transfer bias control (Tb) is executed, but should only meet the leading edge portion of the sheet P.

The operation panel 9, FIG. 8, may be additionally provided with selecting means for allowing the operator to select a thin sheet in addition to the selecting means assigned to the plain, medium and thick sheets. In such a case, only when the operator selects a thin sheet or high-quality sheet, the background potential control or the exposure control may be executed to enhance the reliable separation of a thin sheet. On the other hand, when the operator does not select a shin sheet, it is not necessary to execute the above control and therefore intentional background contamination, reducing toner consumption.

As stated above, in the illustrative embodiment, assume that the bias Tc is applied to the nip N when the sheet P is absent at the nip and when neither one of the remaining interval transfer bias and leading edge transfer bias is applied. Then, the controller or control means 10 switches the bias Tc within a range lower than the bias Tb.

If toner is present on the background of the drum or image carrier 4 (toner charged to opposite polarity), then it is likely to deposit on and contaminate the belt 11. Also, when use is made of a bias power supply (high-tension power supply 17) as bias applying means, it takes a preselected period of time (startup time) for the bias power supply to output a preselected bias after the turn-on of a switch. More specifically, the application of the bias is delayed. Therefore, it is likely that even if the bias power supply is turned on at the same time as the arrival of the sheet P at the nip N, the delay prevents the bias from being sufficiently applied to the leading edge portion of the sheet P and thereby weakens adhesion between the sheet P and the belt 11.

In the illustrative embodiment, when the sheet P is absent at the nip N and when neither one of the image transfer bias and leading edge transfer bias is applied, the bias Tc lower than the bias Tb is applied. The bias Tc repulses the toner contaminating the background of the drum 4 toward the drum 4 to thereby prevent it from being transferred to the belt. Further, the startup time of the bias Tb is reduced to thereby stabilize the startup, obviating defective sheet separation ascribable to the delay of the bias application.

The controller 10 controls the bias Tb either continuously or stepwise such that the bias coincides with the bias Ta. More specifically, although a low bias Tb is advantageous in the aspect of sheet separation, it degrades the transfer of toner from the drum or image carrier 4 to the sheet P and is therefore apt to make image transfer to the leading edge portion of the sheet P defective. In light of this, the controller 10 switches the bias Tb continuously or stepwise such that the bias Tb coincides with the bias Ta. This successfully obviates defective image transfer to the leading edge portion of the sheet P while insuring reliable sheet separation.

Assume that the distance between the leading edge of the sheet P in the direction of conveyance to the preselected position is L. Then, the illustrative embodiment includes varying means for varying at least one of the distance L and bias Tb. With this varying means, it is possible to execute delicate control in accordance with the kind of the sheet P as well as the condition of use and thereby to insure stable sheet conveyance.

The copier 2 is provided with at least one of inputting means for allowing the operator to input the kind of the sheet P to use and automatic identifying means 16 capable of automatically identifying the kind of the sheet P. The controller 10 switches the bias Ta within the previously stated range in accordance with the output of at least one of the inputting means (operation panel 9) and automatic identifying means 16. More specifically, when the sheet P is relatively thick, defective sheet separation rarely occurs because of the hardness of the sheet P, but defective image transfer is apt to occur if the image transfer bias is low. The above control executed in accordance with the output of at least one of the inputting means and automatic identifying means 16 solves this problem.

Assume that the copier 2 includes a plurality of sheet cassettes or sheet storing members 6*a*, 6*b* each being loaded with a stack of sheets of a particular size. Then, the varying means varies at least one of the distance L and bias Tb in accordance with the sheet cassette 6*a* designated. Therefore, by varying at least one of the distance L and bias Tb cassette by cassette, it is possible to execute more delicately control the bias Tb at the leading edge portion of the sheet P and therefore to realize more stable sheet conveyance.

The sheet P is representative of a recording medium having a front side and a reverse side. The fixing unit or fixing means 8 fixes a toner image transferred to the front side of the sheet P. Reversing means reverses the sheet P carrying the fixed toner image thereon and again conveys it to the nip N in order to form a toner image on the reverse side of the same sheet P. At the time of image transfer to the reverse side, the controller 10 switches the bias Tb such that it coincides with the bias Ta.

More specifically, when a toner image is transferred to the reverse side of the sheet P carrying the fixed toner image on its front side, a back curl is apt to occur in the sheet P toward the belt 11. In addition, heat used for fixation reduces the amount of moisture of the sheet P and thereby increases electric resistance. The back curl and high electric resistance are desirable from the sheet separation standpoint. The high electric resistance, however, renders defective image transfer conspicuous and is apt to render the image defective due to discharge after image transfer. This is why the controller 10 controls the bias Tb to the bias Ta when a toner image is to be transferred to the reverse side of the sheet P, so that the bias of the same size as the bias Ta is applied to the leading edge portion of the sheet P also. With this control, it is possible to insure high-quality images by obviating defective images ascribable to defective image transfer and discharge after image transfer.

The control means 10 plays the role of background potential control means at the same time. The background potential control means controls a background potential produced by a difference between the charge potential of the charge roller or charging means 26 and the bias for development of the developing unit 28. More specifically, the control means 10 makes the background potential on the portion of the drum 4 corresponding to the leading edge interval lower than the background potential on the portion of the drum 4 corresponding to the remaining interval. Such background potential control allows a small amount of toner to deposit on the leading edge portion of the sheet P. This weakens electrostatic adhesion between the sheet P and the drum 4 and therefore promotes reliable sheet separation, compared to the case wherein such toner is absent. This is particularly true with thin sheets thinner than plain sheets.

Further, the control means 10 plays the role of exposure control means for controlling exposure effected by the exposing unit or latent image forming means 31. More specifically, the control means 10 controls the exposing unit 31 such that a small amount of toner deposits on the portion of the drum 4 corresponding to the leading edge interval. Such a small amount of toner is therefore transferred from the drum 4 to the leading edge portion of the sheet P. This also weakens electrostatic adhesion between the sheet and the drum 4 and therefore promotes reliable sheet separation, compared to the case wherein such toner is absent. This is particularly true with thin sheets thinner than plain sheets.

The background potential control means and exposure control means are used to control at least one of the background potential and exposure in accordance with the output of at least one of the operation panel 9, automatic identifying means 16, and designated sheet cassette 6. It is therefore possible to deposit a small amount of toner on the leading edge portion of the sheet P when the sheet P is of the kind that is difficult to separate, e.g., a thin sheet or to deposit no toner on the above portion of the sheet P when the sheet P is of the kind that is easy to separate, e.g., a medium sheet. This is successful to obviate wasteful toner consumption and background contamination.

Various modifications will become possible for those skilled in the art after receiving the teachings of the present disclosure without departing from the scope thereof.

What is claimed is:

1. An image transferring and recording medium conveying device comprising:

a belt forming a nip for image transfer between said belt and an image carrier for conveying a recording medium via said nip to thereby transfer a toner image formed on said image carrier to said recording medium;

bias applying means for applying a bias for image transfer to said nip;

control means for controlling said bias applying means, wherein assuming that a leading edge transfer bias Tb is applied during a leading edge interval in which a leading edge portion of the recording medium between a leading edge and a preselected position in a direction of medium conveyance moves away from said nip, and that a remaining interval transfer bias Ta is applied to said nip during a remaining interval in which a remaining portion of said recording medium moves away from said nip, said control means switches said leading edge transfer bias Tb within a range lower than said remaining interval transfer bias Ta, and wherein a between-medium transfer bias Tc is applied when neither one of said remaining interval transfer bias Ta and said leading edge transfer bias Tb is applied, and said control means switches said between-medium transfer bias Tc within a range lower than said leading edge transfer bias Tb.

2. The device as claimed in claim 1, further comprising varying means for varying a distance L, where L is a distance between the leading edge and the preselected position of the recording medium.

3. The device as claimed in claim 1, wherein said control means controls said leading edge transfer bias Tb either continuously or stepwise such that said leading edge transfer bias Tb coincides with said remaining interval transfer bias Ta.

4. The device as claimed in claim 3, further comprising varying means for varying a distance L, where L is a distance between the leading edge and the preselected position of the recording medium.

5. The device as claimed in claim 3, further comprising varying means for varying said leading edge transfer bias Tb.

6. The device as claimed in claim 1, further comprising varying means for varying said leading edge transfer bias Tb.

7. An image forming apparatus comprising:

charging means for uniformly charging a surface of an image carrier;

latent image forming means for forming a latent image on the charged surface of said image carrier;

developing means for developing the latent image to thereby produce a corresponding toner image; and an image transferring and recording medium conveying device;

said image transferring and recording medium conveying device comprising:

a belt forming a nip for image transfer between said belt and an image carrier for conveying a recording medium via said nip to thereby transfer the toner image from said image carrier to said recording medium;

bias applying means for applying a bias for image transfer to said nip;

control means for controlling said bias applying means;

wherein assuming that a leading edge transfer bias Tb is applied during a leading edge interval in which a leading edge portion of the recording medium between a leading edge and a preselected position in a direction of medium conveyance moves away from said nip, and that a remaining interval transfer bias Ta is applied to said nip during a remaining interval in which a remaining portion of said recording medium moves away from said nip, said control means switches said leading edge transfer bias Tb within a range lower than said remaining interval transfer bias Ta, and wherein a between-medium transfer bias Tc is applied when neither one of said remaining interval a transfer bias Ta and said leading edge transfer bias Tb is applied, and said control means switches said between-medium transfer bias Tc within a range lower than said leading edge transfer bias Tb.

8. The apparatus as claimed in claim 7, wherein said control means controls said leading edge transfer bias Tb either continuously or stepwise such that said leading edge transfer bias Tb coincides with said remaining interval transfer bias Ta.

9. The apparatus as claimed in claim 7, further comprising varying means for varying a distance L, where L is a distance between the leading edge and the preselected position of the recording medium.

10. The apparatus as claimed in claim 9, further comprising a plurality of sheet storing members each being loaded with a stack of recording media of a particular kind, wherein said varying means varies said distance L in accordance with a designated one of said plurality of sheet storing members.

11. The apparatus as claimed in claim 9, further comprising a plurality of sheet storing members each being loaded with a stack of recording media of a particular kind, wherein said varying means varies said leading edge transfer bias Tb in accordance with a designated one of said plurality of sheet storing members.

12. The apparatus as claimed in claim 7, further comprising at least one of inputting means for allowing an operator of said apparatus to input a kind of the recording medium and automatic identifying means for automatically determining the kind of the recording medium, wherein said control means switches said leading edge transfer bias Tb within said range in accordance with an output of either one of said inputting means and said automatic identifying means.

13. The apparatus as claimed in claim 7, wherein the recording medium comprises a sheet having a front side and a reverse side.

14. The apparatus as claimed in claim 7, further comprising varying means for varying said leading edge transfer bias Tb.

15. An image forming apparatus comprising:

charging means for uniformly charging a surface of an image carrier;

latent image forming means for forming a latent image on the charged surface of said image carrier;

developing means for developing the latent image to thereby produce a corresponding toner image;

an image transferring and recording medium conveying device, including:

a belt forming a nip for image transfer between said belt and an image carrier for conveying a recording medium via said nip to thereby transfer the toner image from said image carrier to said recording medium;

bias applying means for applying a bias for image transfer to said nip;

control means for controlling said bias applying means, fixing means for fixing the toner image transferred to a front side of the recording medium; and reversing means for reversing the recording medium carrying the toner image fixed on the front side thereof and conveying said recording medium to said nip for thereby transferring a toner image to a reverse side of said recording medium, wherein assuming that a leading edge transfer bias Tb is applied during a leading edge interval in which a leading edge portion of the recording medium between a leading edge and a preselected position in a direction of medium conveyance moves away from said nip, and that a remaining interval transfer bias Ta is applied to said nip during a remaining interval in which a remaining portion of said recording medium moves away from said nip, said control means switches said leading edge transfer bias Tb within a range lower than said remaining interval transfer bias Ta, and wherein when the toner image is to be transferred to the reverse side of the recording medium, said control means switches said leading edge transfer bias Tb such that said leading edge transfer bias Tb coincides with said remaining interval transfer bias Ta.

16. An image forming apparatus comprising:

charging means for uniformly charging a surface of an image carrier;

latent image forming means for forming a latent image on the charged surface of said image carrier;

developing means for developing the latent image to thereby produce a corresponding toner image;

an image transferring and recording medium conveying device, including:

a belt forming a nip for image transfer between said belt and an image carrier for conveying a recording medium via said nip to thereby transfer the toner image from said image carrier to said recording medium;

bias applying means for applying a bias for image transfer to said nip;

control means for controlling said bias applying means, and background potential control means for controlling a background potential produced by a difference between a charge potential of said charging means and a developing bias of said developing means, wherein assuming that a leading edge transfer bias Tb is applied during a leading edge interval in which a leading edge portion of the recording medium between a leading edge and a preselected position in a direction of medium conveyance moves away from said nip, and that a remaining interval transfer bias Ta is applied to said nip during a remaining interval in which a remaining portion of said recording medium moves away from said nip, said control means switches said leading edge transfer bias Tb within a range lower than said remaining interval transfer bias Ta, and wherein said background potential control means executes control such that the background potential on a portion of said image carrier corresponding to said leading edge interval is lower than the background potential on a portion of said image carrier corresponding to said remaining interval.

17. The apparatus as claimed in claim 16, further comprising exposure control means for controlling exposure to be performed by said latent image forming means, wherein said exposure control means causes the latent image to be formed such that a small amount of toner deposits on said portion of said image carrier corresponding to said leading edge interval.

18. The apparatus as claimed in claim 17, further comprising:

a plurality of medium storing means each being loaded with a stack of recording media of a particular kind;

inputting means for allowing an operator of said apparatus to input a kind of the recording medium; and automatic identifying means for automatically determining the kind of the recording medium;

wherein at least one of background potential control and exposure control is executed in accordance with an output of at least one of said inputting means and said automatic identifying means and the tray designated.

* * * * *